United States Patent [19]

Mihara et al.

[11] 4,430,872

[45] Feb. 14, 1984

[54] METHOD AND APPARATUS FOR PLATE EDGE PREPARATION FOR UOE PIPE MAKING PROCESS

[75] Inventors: Yutaka Mihara, Tokyo; Tomoshige Sudo, Yokohama, both of Japan

[73] Assignee: Nippon Kokan Kabushiki Kaisha, Tokyo, Japan

[21] Appl. No.: 233,824

[22] Filed: Feb. 12, 1981

[30] Foreign Application Priority Data

Feb. 14, 1980 [JP] Japan ..... 55-18010

[51] Int. Cl.[3] ..... B21D 51/00; B21D 11/00; B21D 39/00

[52] U.S. Cl. ..... 72/51; 72/319; 72/388

[58] Field of Search ..... 72/51, 316, 319, 320, 72/321, 322, 387, 388, 414, 475

[56] References Cited

U.S. PATENT DOCUMENTS 3,400,568 9/1968 Brandner ..... 72/319 X 4,142,394 3/1979 Damman ..... 72/386 X 4,218,909 8/1980 Wright ..... 72/320

4,294,095 10/1981 Kawano et al. ..... 72/51

*Primary Examiner*—Ervin M. Combs

*Attorney, Agent, or Firm*—Moonray Kojima

[57] ABSTRACT

Method and apparatus for preparing an edge of a steel plate in a UOE process of making steel pipes, wherein a steel plate edge is positioned between a male die and a female die which have a curvature as desired in the edge, and held substantially horizontally by holding means outside the die, and the female die is moved against the edge and the male die by action of a lever which is pivoted about a fulcrum point which is inward of the plate edge and which has a moving means at the other end of the lever opposite the fulcrum point a predetermined distance from the female die. Advantageously, such method and apparatus enable formation of steel pipes using the UOE method having thicknesses previously difficult to produce without peaking of the produced seams.

10 Claims, 8 Drawing Figures

METHOD AND APPARATUS FOR PLATE EDGE PREPARATION FOR UOE PIPE MAKING PROCESS

BACKGROUND OF THE INVENTION

This invention relates to method and apparatus for preparing the longitudinal edge of a steel plate in a UOE process, and more particularly, to an improved method and apparatus which effectively broadens the range of widths and thicknesses of steel plates utilizable in the manufacture of pipes.

In making steel pipes using the UOE method, a steel plate is first cut and formed into bevels at both longitudinal edges followed by U-ing and O-ing and then the bevels are abutted together and subsequently, subjected to welding to create a seam along the abutted beveled edges. If the pressing load is insufficient during the O-ing, the butted edges would not be sufficiently effected with the press forming and the edge parts would be abutted in a straight condition to produce so-called peaking, which is a disorder out of a true circle.

For solving such problems, the conventional method involved bending a steel plate at its longitudinal edges by a predetermined curvature prior to U-ing. One of the known processes uses an upper roll and a lower roll to bend the edges of a steel plate. This process is suitable for bending the edges of a thin steel material. But disadvantageously, if the steel is thick or the size of its width is small, this prior method and apparatus require that the forming force be rapidly increased, and consequently, that the rolls be large scaled since they should be kept rigid. In another prior method and apparatus, an upper die and a lower die (which is called a C-press) are employed using oil pressure for strongly pressing the edges of a steel plate. Disadvantageously, in this method and apparatus, when a thick steel plate is acted upon, an outer edge part of the lower die slips from contact by plastic deformation due to reaction force of theplate, so that a clearance is created between the upper surface of the plate toward the edge and the outer portion of the upper die, and hence the steel plate is not acted upon with any degree of force at the edge. Thus, the steel plate is only acted upon and bent at the parts which contact the two dies. The bending moment does not effectively act upon the entire surface area and after the bending process, straight parts remain at the ends of the side edges, resulting in the so-called peaking phenomenon.

In order to solve the foregoing problem, a bending system was proposed in Japanese Patent Application SN 53-135,877 comprising a male die and a female die between which a side edge of a steel plate may be disposed. The female die is supported turnably around a fulcrum, which fulcrum is movable in a vertical direction to provide pressing force onto the steel plate. The female die can concentrate load to the end portion of the side edges of the steel plate and desired bending can be attained. However, disadvantageously, the amount of force required to move upwardly the female die is substantial in that the force is applied directly vertically to the fulcrum.

Thus, there is an urgent need in the prior art for a method and apparatus which can effectively prepare the longitudinal edges of a steel plate for the UOE process of pipe making, while utilizing practical amounts of pressure and which can be utilized for greater thicknesses of steel plate and smaller widths of the edges.

SUMMARY OF THE INVENTION

Accordingly, an object of the invention is to overcome the aforementioned and other disadvantages and deficiencies of the prior art.

Another object is to provide a method and apparatus for preparing edges of steel plates for manufacturing pipes in accordance with the UOE process, wherein greater thicknesses of steel plates can be utilized and smaller widths of edges can be utilized and which utilizes less pressing force than conventionally used.

A further object is to provide bending of edges of steel plates for use in UOE process without any resulting peaking conditions of the seams.

The foregoing and other objects of the invention are attained in a method and apparatus for preparing longitudinal edges of a steel plate for use in a UOE process of manufacturing pipes, wherein a male die and a female die having desired curvatures are disposed to have the longitudinal edge of the plate positioned therebetween for bending action. The male die is held stationary. The female die is anchored selectively on an extended bed having one end rotatably held to act as a fulcrum, and the other end is connected to a piston means for moving the bed rotatably around the fulcrum. Holder means are provided for holding the steel plate inward from the edge thereof being worked on by the male and female dies. The male die is convex-like with the center of curvature extending inward from the die surface. The female die has its center of curvature extending outward from its die surface. The curvatures of the two dies are that which is desired of the edges when bent.

In operation, the edge of the steel plate to be bent is placed between the two die surfaces, and held substantially horizontally by the holder means outside of the dies. The piston means is then actuated to push up the corresponding end of the bed and cause the female die surface to contact the plate edge surface and thereby press same against the male die surface, and cause bending line by line successively along the curvature as the bed is rotated about the fulcrum, until the entire edge surface is bent as desired. Advantageously, there is no peaking of the edges, and the amount of force required to operate the apparatus is substantially less than that conventionally required. Moreover, with the use of less force, a greater thickness of plate can be bent and a smaller width of plate canbe operated on. Depending on the ratio of the distance from the fulcrum point to the location of the female die on the bed, to the distance from the fulcrum point to the point of application of upward moving force, the amount of force applied can be optimized for the thickness of plate being operated on.

A feature of the invention is a method and apparatus for preparing longitudinal edges of a steel plate for use in the UOE process of manufacturing pipes, wherein a male die having a desired curvature whose center extends inward from the die surface, and a female die having a corresponding or larger curvature whose center extends outward from the die surface, are positioned to have the edge of the steel plate therebetween for bending, and wherein the female die is anchored on an extended bed having one end thereof rotatably attached to a support means to form a fulcrum, and another end thereof directed toward the edge being bent, with a piston means for moving the other end and thus rotate the bed about the fulcrum and provide pressing force to the female die and cause same to bend the edge against the male die.

Another feature is the application of force along the entire die surface of the female die by use of a lever means operable about a fulcrum point which is located in the general direction of the center of curvature of the two dies.

A further feature is the clamping of the steel plate inward from the edge to be bent, to firmly hold the steel plate at a substantially constant height during bending operation.

Another feature is the selective anchoring of the female die on a bed having one end rotatably attached to one end to form a fulcrum point and having at the other end thereof a power means for moving the bed about the fulcrum point and consequently move the female die against an anchored male die with the steel plate edge to be bent, disposed therebetween.

Another feature is the use of an oil pressure cylinder piston for moving the bed and thereby move the female die against the male die and cause bending of thesteel plate edge.

A further feature is the moving outwardly of the line of contact between the male and female dies and the steel plate held therebetween, as the bed is raised about the fulcrum.

Another feature is the corresponding curvatures of the faces of the male and female dies with suitable placement thereof to provide for different thicknesses of thesteel plate to be bent.

DETAILED DESCRIPTION OF THE PREFERRED EMBODIMENTS

Figure 1:
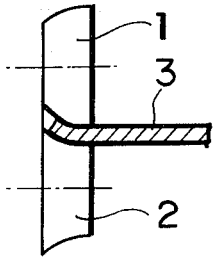
FIG 1 (PRIOR ART)
FIG. 1 depicts, in a side view, conventional rolls for bending an edge.

FIG. 1 shows a prior art apparatus for bending the longitudinal edge of a steel plate, wherein a steel plate 3 is bent at its edges by means of an upper roll 1 and a lower roll 2. This process is suitable for bending the edges of a relatively thin steel plate. However, if the steel plate is relatively thick or the width of the edges is relatively small, the forming force of the rolls must be increased. Since the rolls should be kept rigid, this requires that the rolls be large scaled.

Figure 2:
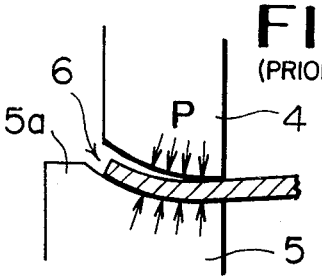
FIG 2 (PRIOR ART)
FIG. 2, depicts, in a side view, conventional press forming mechanism for bending an edge.

In FIG. 2, there is depicted another prior art apparatus comprising an upper die 4 and a lower die 5. The dies are strongly pressed together using oil pressure means, to cause the bending of the steel plate at the edges. However, when a thick steel plate is being operated on, an outer edge part 5*a* of the lower die 5 escapes by plastic deformation due to reaction force of the plate so that a clearance 6 is created between the upper surface edge portion of the plate and the upper die 4, and the steel plate is not acted on with any substantial force at the edge. Thus, the steel plate is only bent at the parts corresponding to and in contact with the dies 4 and 5. Thus, effective bending moment is not imparted to the entire edge surface and after the bending process is completed, some straight parts remain at the ends of the side edges.

Figure 3:
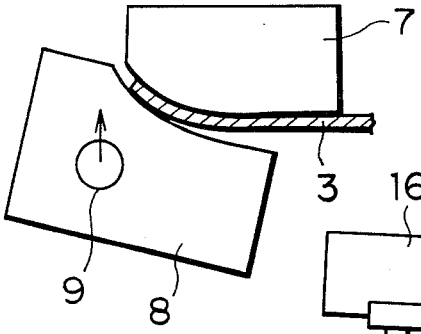
FIG 3 (PRIOR ART)
FIG. 3 depicts, in a side view, a bending apparatus utilizing a vertically movable fulcrum in the female die.

FIG. 3 depicts another prior bending system wherein a steel plate 3 has its side edge held between a male die 7 and a female die 8. The female die 8 is supported turnably around a fulcrum 9. Moving force, such as shown by the arrow, is applied in a vertical direction, such as by means of an oil pressure piston (not shown), directly. According to this system, it is possible to concentrate bending pressure to the steel plate 3 at the end portion of the side edge by way of the female die 8, and desired bending can be attained. However, the mechanism used to move vertically upward the female die 8 with force applied to the fulcrum 9, would inevitably have to be large scaled. Simple analysis of a force diagram of the forces applied to the fulcrum 9 in FIG. 3 would show that the forces would have to be proportionally increased with increased thickness with some non-working force components.

Figure 4:
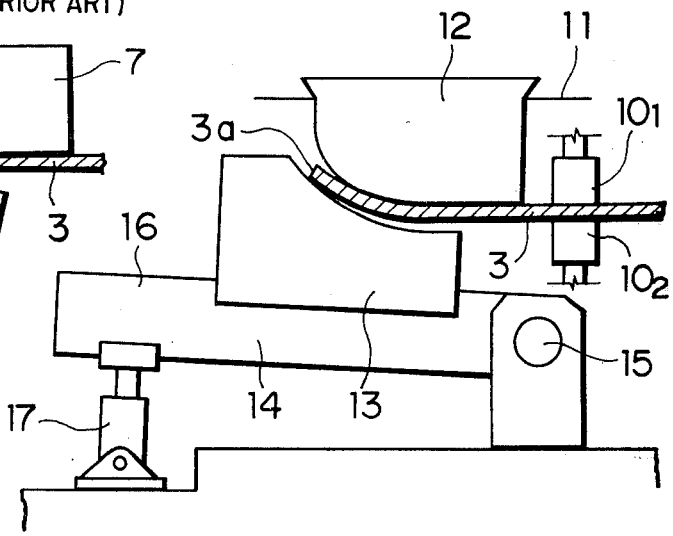
FIG. 4 depicts, in a side view, an illustrative embodiment of the invention.

Turning now to the illustrative embodiment of the invention, FIG. 4 depicts a steel plate 3 held substantially horizontally between clamping means $\mathbf{10}_1$ and $\mathbf{10}_2$, with the edge 3*a* to be bent disposed between male die 12 and female die 13. The male die 12 is secured to an upper fixture 11 and is positioned on end side edge 3*a* of the steel plate. The female die 13 is positioned on the other side of the edge of the steel plate, as depicted. The male die 12 has a predetermined curvature matching the desired curvature of the bent plate. The curvature of the female die 13 has a radius equal to or larger than the curvature of the male die 12. The female die may be preferably larger than the male die in curvature by an amount equal to the thickness of the steel plate. As depicted, the center of curvature of the male die is inward of the die surface, and the center of curvature of the female die is outward of its die surface.

The female die 13 is adjustably fixed in a selected position on an upper surface of a bed 14. One end of the bed 14 is rotatably pivoted around an axis 15 to form a fulcrum thereat. The fulcrum is positioned inward from and under the side edge 3*a* of the steel plate as depicted. The other end of the bed 14 serves as an actuating part 16 extending outwardly from the side edge 3*a*. Under the actuating part 16, there is installed a push-up device 17 comprising an oil cylinder piston. By actuating the push-up device 17, the bed 14 having the female die 13 anchored thereon is rotated about the fulcrum point 15.

Figure 5:
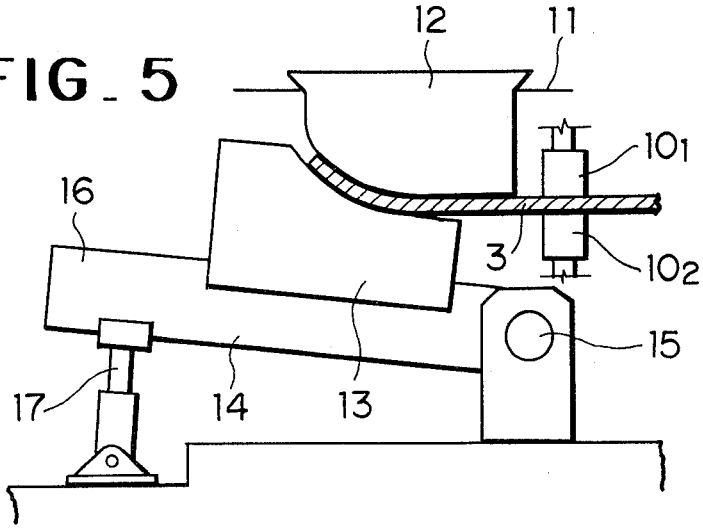
FIG. 5 depicts, in a side view, the press bending action of the embodiment of FIG. 4.

When the side edge 3*a* of the steel plate 3 is positioned under male die 12, the steel plate 3 is also held betwen the clamping means $\mathbf{10}_1$ and $\mathbf{10}_2$ to keep the steel plate at a substantially constant height during the bending operation. Under this condition, the push-up device 17 moves upwardly and pushes the actuating part 16 of the bed 14, so that the female die 13 moves upwardly around the fulcrum point, and thus carries out the bending function. With respect to this bending, since the fulcrum 15 is positioned inward from and under the side edge 3*a*, the inner end of the curve of the female die 13 surface, that is, the part closest to the fulcrum point 15, first contacts the side edge 3*a* as shown in FIG. 4, and a contact point (along a line extending the length of the longitudinal (i.e. in a direction extending into the drawing) edge) at which bending occurs, of the female die 13 to the side edge 3*a*, moves in succession outwardly, that is away from the direction of the fulcrum, while the female die is being elevated by rotating movement of the bed 14. At the highest position, as shown in FIG. 5, the force of the curve acting on the side edge 3*a*, is further oriented toward the center of curvature of the male die 12. In this manner, the bending of the longitudinal edge of plate 3 is uniformly and accurately accomplished without the presence of any peaking or straight parts.

Figure 6:
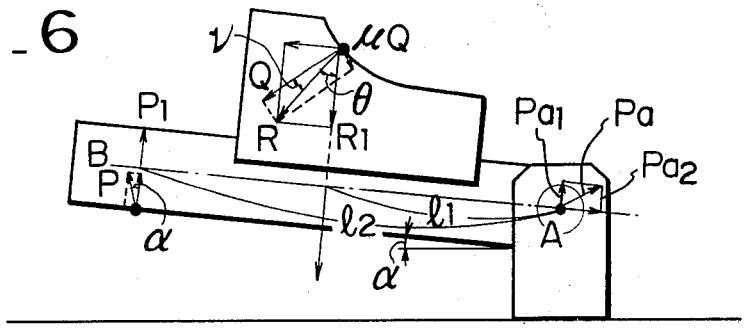
FIG. 6 depicts, force diagrams of the forces acting on the bed, the female die, and the fulcrum points.

FIG. 6 depicts the forces acting on different parts of the bending system of the invention. Analyzing the forces on the female die, assume that the component of the effective force for bending is "Q", and the friction coefficient at the tangent with the side edge 3*a* is "$\mu$", friction force "$\mu$Q", and $$\mu = \tan \gamma$$

Therefore, the resultant force of "Q" and "$\mu$Q" is $$R = \frac{Q}{\cos\gamma}$$

On the other hand, assuming that the pressing force acting on the push-up device 17 is "P" and component "$P_1$" of force in the vertical direction of A and B is $$P_1 = P \cos \alpha$$

and component $R_1$ of R in a vertical direction of A and B is $$R_1 = R \cos \theta$$

From proportion of moment of forces acting on point A is $$R_1 l_1 = P_1 l_2$$

$$\therefore \frac{Q}{\cos\gamma} \cdot \cos\theta \cdot l_1 = P \cdot \cos\alpha \cdot l_2$$

$$\therefore P/Q = \frac{\cos\theta}{\cos\gamma \cdot \cos\alpha} \cdot \frac{l_1}{l_2}$$

Therefore, the smaller the $l_1/l_2$, the smaller becomes the value of P/Q, and the press load becomes smaller for the amount of bend-desired.

The forces acting on the fulcrum are depicted in FIG. 6 with "Pa" being the force acting on the fulcrum 15, "$Pa_1$" and "$Pa_2$" being component forces.

In this invention, since one point (a line along the longitudinal edge) contact is made at the end part of the side edge of the steel plate when female die 13 is elevated by rotating bed 14, it is possible to concentrate the bending moment on the particular line at a single instant of time throughout the end part, so that the bending process may be performed to the end point at the predetermined curvature without creating any clearance, such as produced by prior art systems, such as shown in FIG. 2. Furthermore, since the pressing force effectively utilizes the lever principle of the bed 14 to accomplish the bending process, a smaller actuating force at the piston 17 is sufficient. Thus, the inventive apparatus is simpler and more practical in comparison with the prior system, such as shown in FIG. 3, for example.

Figure 7:
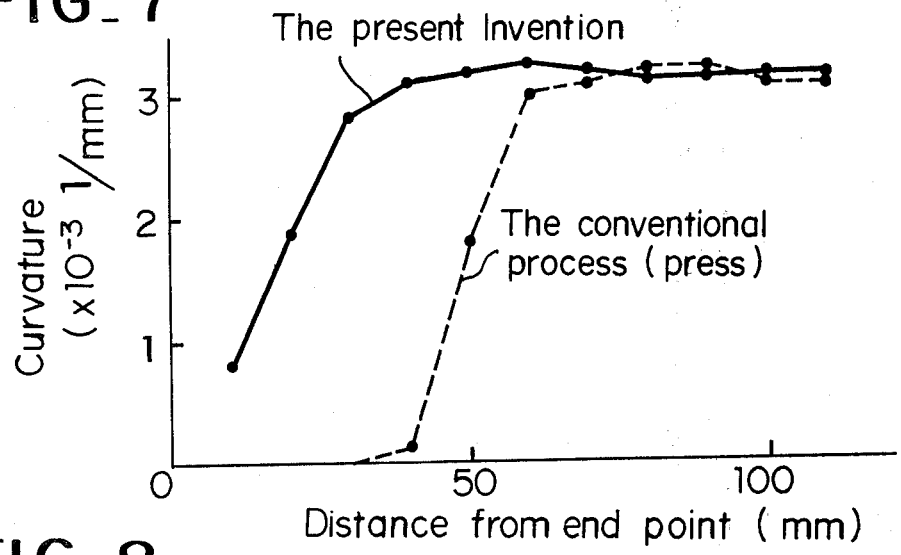
FIG. 7 depicts, in graph form, a comparison between the invention and a conventional press process and their effects on edge bending.

FIG. 7 shows the difference in the imparting of curving force between the instant invention and the convention pressing method such as shown in FIG. 2. In the comparison tests, in both cases, the desired curvature radius was 40 cm, and a pressing force of 1500 tons was used with respect to a steel plate of 25.4 mm in thickness. The results are depicted in the graph of FIG. 7. In that graph, the abscissa shows distance from the end point of the side edge of the steel plate, and the ordinate shows curvature of the steel plate. The solid line shows the invention, and the broken line shows the prior art method. As is seen, using our invention, the bending is closer to the end portion than with the prior art.

Figure 8:
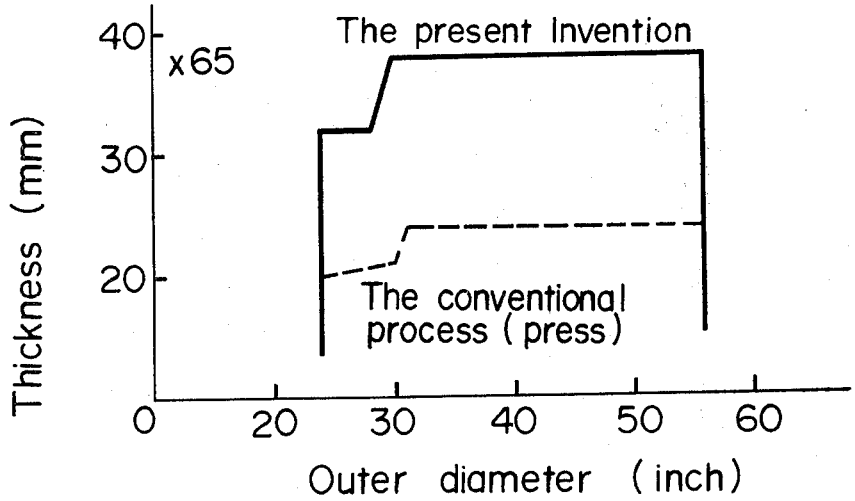
FIG. 8 depicts, in graph form, a comparison between the invention and a conventional press process, such as that depicted inf FIG. 3, and their effects on the thicknesses of plates utilizable with the respective processes.

FIG. 8 shows a comparison between the invention and a conventional pressing method, such as shown in FIG. 3, and the range of thicknesses of thesteel plate which can be bent by the respective systems for the same pressing forces. In the graph, the abscissa shows the outer diameter of the formed pipe, and the ordinate shows the thickness. The solid line shows the invention method, and the broken line shows the prior method, and the respective thicknesses and diameters which can be bent with the use of the respective systems. As can be appreciated, according to the invention, the available range of thicknesses of steel plates for making pipes is substantially broadened using the same pressing force as conventionally used.

The foregoing description is illustrative of the principles of the invention. Numerous extensions and modifications thereof would be apparent to the worker skilled in the art. All such extensions and modifications are to be considered to be within the spirit and scope of the invention.

What is claimed is:

1. In a method of bending a longitudinal edge of a metal plate for use in making pipes in accordance with the UOE process, by using an anchored male die of a predetermined curvature with a movable female die of a corresponding or larger curvature, with the plate to be bent held therebetween, said male die and said female die each having die surfaces, and applying a force to the female die thereby to produce a pipe with no peaking created on the seams after O-ing; the improvement comprising mounting the female die on an extended bed having two ends, one end being rotatably attached to a support about a fulcrum point;

adjusting the location of the female die on the bed to position its die surface opposite the die surface of the male die, and at a desired distance from the fulcrum point of the bed on the support;

and applying a force at the other end of the bed, causing the bed to rotate about the support and thereby cause pressing force to be applied by the female die to the plate against the male die.

2. The method of claim 1, wherein the female die surface contacts the surface of the plate and the plate contacts the male die starting at the end closest to the support and moves succesively toward the other end as the said applying force moves upward rotatably said bed, and causing said female die to move progressively upward.

3. The method of claim 1, wherein said plate is a steel plate and is held substantially at a constant height during the bending operation.

4. The method of claim 1, wherein the position of said female die on said bed is adjusted to provide optimal force for the thickness of the plate being employed.

5. The method of claim 1, wherein said female die has a center of curvature extending outward from its surface and said male die has a center of curvature extending inward from its surface, with said support located in the general direction of said centers of curvatures.

6. An apparatus for preparing the edge of a metal plate for use in making pipes in accordance with the UOE process, comprising a male die fixedly attached to a structure and having a die surface with a curvature substantially corresponding to the curvature desired of the edge to be bent; a female die having a die surface with a curvature substantially equal to or larger than said curvature of said male die and disposable to face the die surface of said male die with said edge of said plate to be bent being positionable between said male die and said female die; an extended bed having two ends, one end of said bed being rotatably attached to a support to form a fulcrum thereat, said female die being mounted on said bed between said two ends with said die surface positioned opposite the die surface of the male die; means for adjusting the location of the female die on the bed to position its surface opposite the die surface of the male die, and at a desired distance from the fulcrum of the bed on the support; and a push-up device for applying a force to said other end of said bed and thereby vertically rotatably move said bed about said fulcrum, whereby said female die will press against said plate and cause said plate surfaces to contact the female die surface and said male die surface at different points as the bed is moved rotatably about said fulcrum until the entire edge is bent to the curvature desired.

7. The apparatus of claim 6, wherein means holds said plate at a substantially constant height during the bending operation, said means comprising clamping means located outside of said die and in the general direction of said support.

8. The apparatus of claim 6, wherein said male die has a predetermined curvature matching the curvature desired of said edge when bent, and wherein said female die has a curvature equal to or larger than the curvature of said male die.

9. The apparatus of claim 6, wherein said female die has a curvature larger than the curvature of said male die by an amount equal to the thickness of the plate to be bent.

10. The apparatus of claim 6, wherein said push-up device comprises an oil pressure driven piston means.

* * * * *